US007379392B1

(12) United States Patent
Benjamin

(10) Patent No.: US 7,379,392 B1
(45) Date of Patent: May 27, 2008

(54) FLEXIBLE CYMBAL ARRAY

(75) Inventor: Kim C. Benjamin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 472 days.

(21) Appl. No.: 11/254,120

(22) Filed: Oct. 17, 2005

(51) Int. Cl.
*H04R 17/00* (2006.01)

(52) U.S. Cl. ..... 367/154; 367/155

(58) Field of Classification Search ..... 367/153, 367/154, 155; 310/800
See application file for complete search history.

(56) References Cited

U.S. PATENT DOCUMENTS 2,650,991 A * 9/1953 Ketchledge ..... 310/329
4,184,093 A * 1/1980 Sullivan ..... 310/331
4,233,477 A * 11/1980 Rice et al. ..... 381/190
4,751,419 A * 6/1988 Takahata ..... 310/324
4,810,913 A * 3/1989 Beauducel et al. ..... 310/337
4,975,616 A * 12/1990 Park ..... 310/339
4,995,014 A * 2/1991 Hoornstra ..... 367/153
5,031,222 A * 7/1991 Takaya ..... 381/190
5,092,243 A * 3/1992 Hawkins et al. ..... 10/210
5,196,755 A * 3/1993 Shields ..... 310/324
5,684,884 A * 11/1997 Nakaya et al. ..... 381/190
7,302,866 B1 * 12/2007 Malkin et al. ..... 73/862.041
2004/0047239 A1 * 3/2004 Benjamin ..... 367/162

* cited by examiner

*Primary Examiner*—Dan Pihulic
(74) *Attorney, Agent, or Firm*—James M. Kasischke; Michael P. Stanley; Jean-Paul A. Nasser

(57) ABSTRACT

A cymbal array for underwater vehicle applications includes piezoelectric discs disposed in a line, a first flex circuit comprising first annular members each affixed to a first side of one of the discs, a first series of cymbal caps each mounted on one of the first annular members, a second flex circuit comprising second annular members each fixed to a second side of one of the discs, and a second series of cymbal caps each mounted on one of the second annular members. The flex circuits each comprise an electrically conductive layer disposed between two electrically insulative layers.

14 Claims, 4 Drawing Sheets

FLEXIBLE CYMBAL ARRAY

STATEMENT OF GOVERNMENT INTEREST

The invention described herein may be manufactured and used by or for the Government of the United States of America for governmental purposes without the payment of any royalty thereon or therefor.

BACKGROUND OF THE INVENTION

1. Field of the Invention

The invention relates to devices producing time varying acoustic pressures, and is directed more particularly to a flexible array of such devices adapted to conform to curved surfaces of underwater vehicles and thereby adapted to be mounted on such curved surfaces.

2. Description of the Prior Art

Flextensional transducers have been used as underwater transducers. Such devices have generally consisted of an active drive element and a shell structure, wherein the motion of the drive element produces a larger motion of the shell structure. Radiating surfaces of the shell structures typically are small compared to the generated acoustic wavelength, making the shell structures suitable for low frequency sonar applications.

In U.S. Pat. No. 5,276,657, there is shown and described an underwater transducer which includes a piezoelectric or electrostrictive ceramic disc with conductive electrodes bonded to its major surfaces. A pair of metal end caps include rims that are bonded to the conductive electrodes, respectively. Each end cap comprises a solid metal disc having a cavity formed in one major surface thereof.

In U.S. Pat. No. 5,729,077, a similar device employs sheet metal caps joined to opposed planar surfaces of the ceramic substrate. When the sheet metal caps are subjected to displacement by pressure, a resulting charge in voltage across the ceramic substrate is sensed. Because of the shape of the sheet metal caps, the transducer is referred to as a "cymbal" transducer. The '077 device has been employed as a hydrostatic sensor for underwater vehicles.

In U.S. Pat. No. 6,798,122, there is shown a compound electro-acoustic transducer for producing acoustic signals having a plurality of elements. Each element has a piezoelectric disk with electrically conductive plates fixed on the top and bottom sides of the piezoelectric disk. A stud is joined to an outer face of each plate. Conductors can be joined to each stud. The elements can be assembled on a resilient structure to form an array. Elements can be used in the array or individually accessed.

Many unmanned underwater vehicles (UUV) are provided with rounded hull surfaces. Because of the rigid nature of the hull surfaces and the rigidity of the arrays, the arrays do not readily conform to such surfaces.

There is thus a need for cymbal arrays which are sufficiently flexible to be mounted onto the curved hulls of underwater vehicles. It is further required that such arrays be sufficiently flexible to be conformed to surfaces exhibiting complex curves, such as bow or nose cone surfaces, which curve around the axis of the UUV and also curve from the outer portion of the hull to the axis of the hull at the center of the nose cone.

SUMMARY OF THE INVENTION

An object of the invention is, therefore, to provide a cymbal array for mounting on curved hull portions of underwater vehicles.

With the above and other objects in view, a feature of the present invention is the provision of a cymbal array for an underwater vehicle. The array includes piezoelectric ceramic discs disposed in a line, a first flex circuit comprising first annular members each affixed to a first side of one of the discs, a first series of cymbal caps each mounted on one of the first annular members, a second flex circuit comprising second annular members each fixed to a second side of one of the discs, and a second series of cymbal caps each mounted on one of the second annular members. The flex circuits each include an electrically conductive layer disposed between two electrically insulative layers.

In accordance with a further feature of the invention, there is provided a cymbal array for an underwater vehicle, the array including a series of piezoelectric ceramic discs disposed in a line, the discs being separated from each other, a first flex circuit fixed to a first side of the discs, the first flex circuit including a plurality of first annular members each fixed to the first side of one of the discs, the first annular members each being of a diameter substantially equal to the diameter of the disc to which the first annular member is fixed, the first annular members each being connected by a first tab to an adjacent first annular member, the first flex circuit comprising a conductive layer laminated between two polyimide layers, and a first series of cymbal caps each mounted on one of the first annular members. The cymbal array further includes a second flex circuit fixed to a second side of the discs, the second flex circuit comprising a plurality of second annular members each fixed to the second side of one of the discs, the second annular members each being of a diameter substantially equal to the diameter of the disc to which the second annular member is fixed, the first annular members each being connected by a second tab to an adjacent second annular member, the second flex circuit comprising a polyimide layer and a copper layer, and a second series of cymbal caps, each mounted on one of the second annular members and opposed to a cymbal cap of the first series of cymbal caps.

The above and other features of the invention, including various novel details of construction and combinations of parts, will now be more particularly described with reference to the accompanying drawings and pointed out in the claims. It will be understood that the particular array embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent, wherein corresponding reference characters indicate corresponding parts throughout the several views of the drawings and wherein.

DESCRIPTION OF THE PREFERRED EMBODIMENTS

Figure 1:
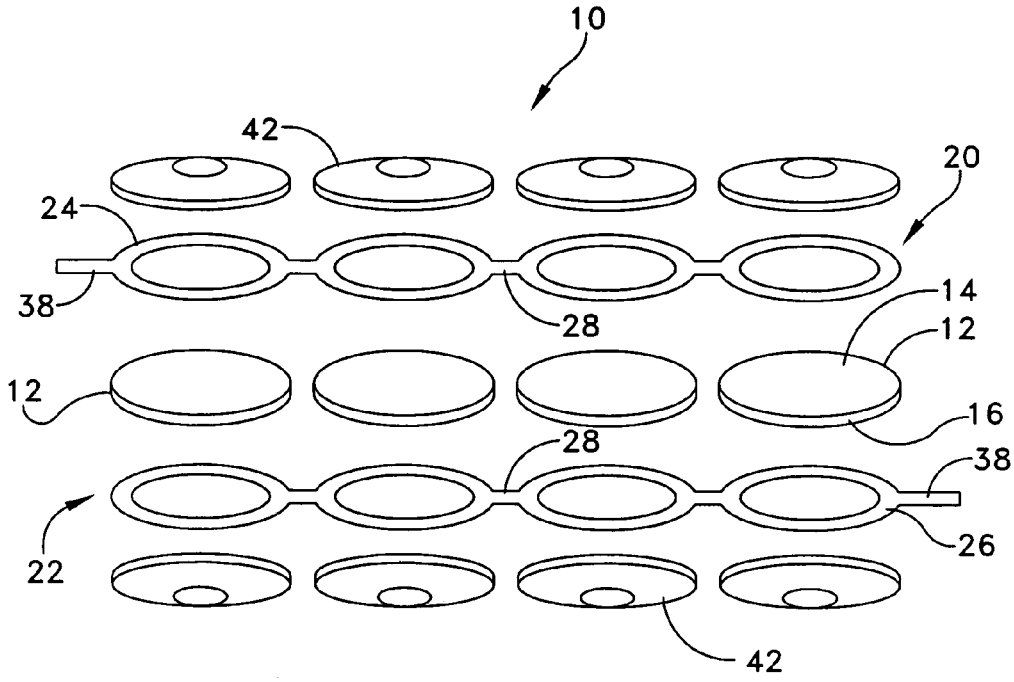
FIG. 1 is an exploded perspective view of one form of cymbal array illustrative of an embodiment of the invention.
Figure 2:
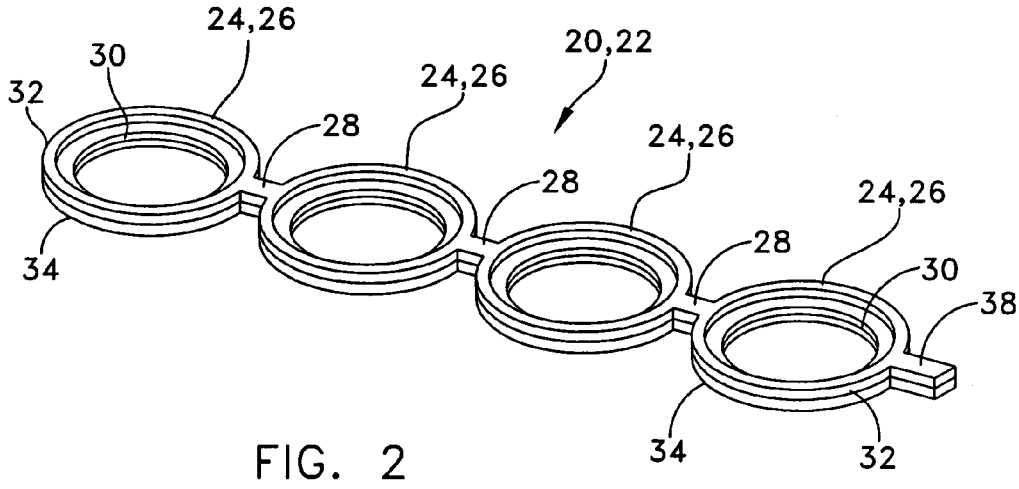
FIG. 2 is a perspective view of a flex circuit portion of the array of FIG. 1.
Figure 3:
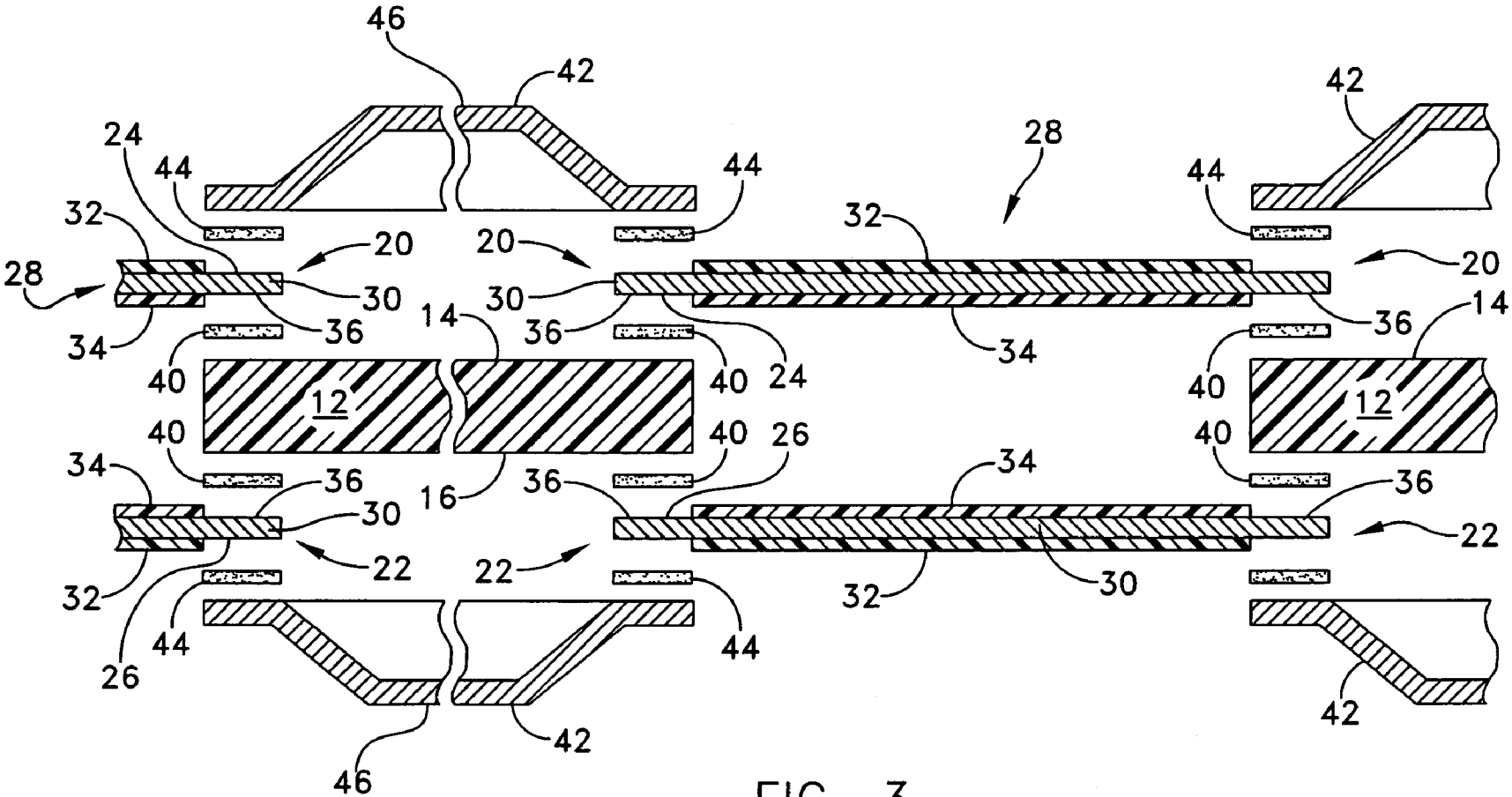
FIG. 3 is a sectional view of a portion of the array of FIG. 2.
Figure 4:
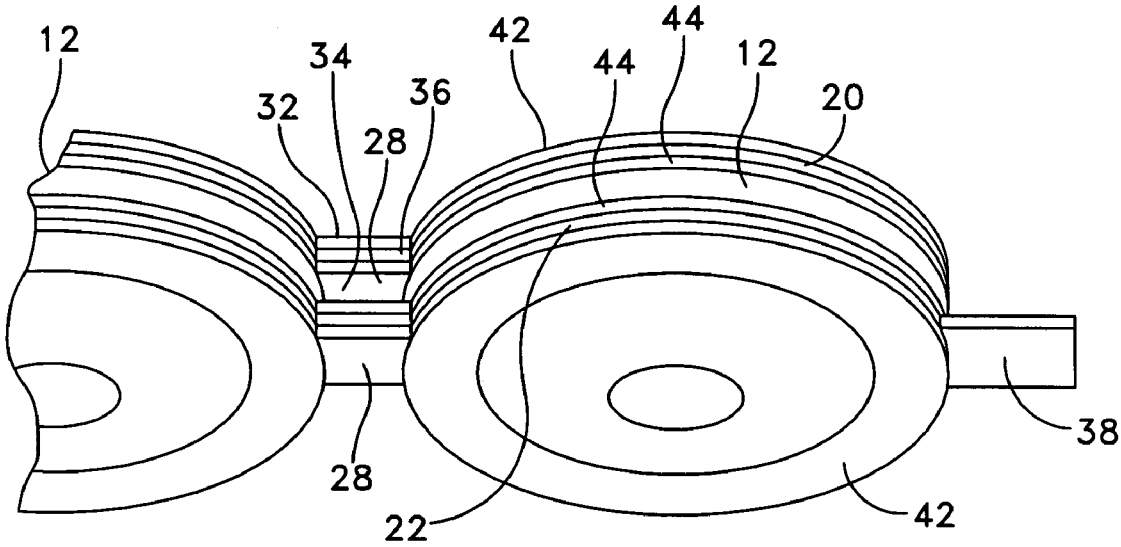
FIG. 4 is a perspective view of a portion of a cymbal array including the components shown in FIG. 3.

Referring to FIGS. 1-3, it will be seen that the illustrative cymbal array 10 includes a series of piezoelectric ceramic discs 12 of a circular configuration.

The piezoelectric ceramic discs 12, when subjected to an electrical charge, become vibrationally active. Tension and compression of the discs generates vibrational activity which is proportional to the applied electrical force. Thus, the piezoelectric effect can be used to vibrate the cymbal caps to produce radiated impulses to detect mines, vessels, and the like.

The piezoelectric ceramics generally are physically strong and chemically inert. Further, they are generally inexpensive to manufacture. The composition, shape, and dimensions of piezoelectric ceramic elements are tailored to meet the requirements of a specific purpose, such as radiation of acoustic signals, and the like. The ceramic element converts the electrical energy into proportional mechanical energy. While piezoelectric ceramic materials are preferred, composite piezoelectric materials could also be used.

Fixed to first sides 14 of the discs 12 is a first flex circuit 20. Similarly, fixed to second side 16 of the discs 12 is a second flex circuit 22. The flex circuits 20, 22 respectively include a plurality of annular members 24, 26 interconnected by tabs 28.

The tabs 28 each include extensions of the annular member components, namely, a thin layer 30 of an electrically conductive material, such as copper, substantially covered on either side by a thin layer 32, 34 of an electrically insulative material, such as a polyimide material.

The piezoelectric ceramic disc 12 preferably is about ½ inch thick. As such, it is generally more or less "rigid", but exhibits sufficient flexibility to conform to a surface having a radius of curvature of about ten times the disc diameter. Accordingly, the discs 12 are adapted to curve sufficiently to conform to the hull of a torpedo or larger vehicle.

The flex circuit annular members 24, 26 each include the central layer 30 of copper (FIG. 3), which is flexible by nature of the thinness of the layer. The outer flexible polymide layer 32 is disposed over the copper layer 30 and is annularly shaped coincident with the remainder of the annular members 24, 26. The inner flexible polyimide layer 34 is disposed on the other side of the copper layer 30 and is provided with a larger inside radius so as to leave an inner portion 36 of the copper layer 30 uncovered and therefore not electrically insulated by the layer 34. Each of the flex circuits 20, 22 is provided with an electrical lead 38 which comprises an extension of the flex circuit 20, 22.

The polyimide layers 32, 34 preferably are of Kapton®, a DuPont polyimide film which maintains physical, electrical and mechanical properties over a wide temperature range. Kapton® provides electronic insulation over extreme ranges of temperature. Adhesives are available for bonding Kapton® to metals and to plastics.

Dry film electrically conductive rings of appropriate adhesive 40 bind the copper layers 30 to the discs 12, thereby connecting the flex circuits 20, 22 to the discs 12. The discs 12 are thereby in circuit with the copper layers 30. In practice, the circumferential edges of the polyimide layers 32, 34 form around the outer edges of the thin copper layers 30, such that the copper layer 30 is not exposed at the outer periphery of the annular members 24, 26 (FIG. 2).

Cymbal caps 42 are adhesively bonded to the flex circuits 20, 22 by rings 44 of dry film adhesive. The caps 42 are typically of brass, tungsten, or titanium. However, inasmuch as the caps 42 are insulated from the conductive layer 30 by the non-conductive layer 32, and form no part of an electrical circuit, they can be of a plastics material. The caps 42 are configured to change shape in accordance with the changing dimensions of the discs 12.

In operation, an electrical charge applied to the discs 12 causes vibration of the discs, which in turn, causes the caps 42 to expand and compress at their centers 46, somewhat toward the discs 12. Movement of the cap center portions 46 toward and away from the discs 12 causes the disc 12 to generate acoustic signals in rapid succession. Inasmuch as the discs 12 are piezoelectric members, the reconfiguration of the discs by the electrical excitation is transmitted through the adhesive 40 to caps 42.

Figure 5:
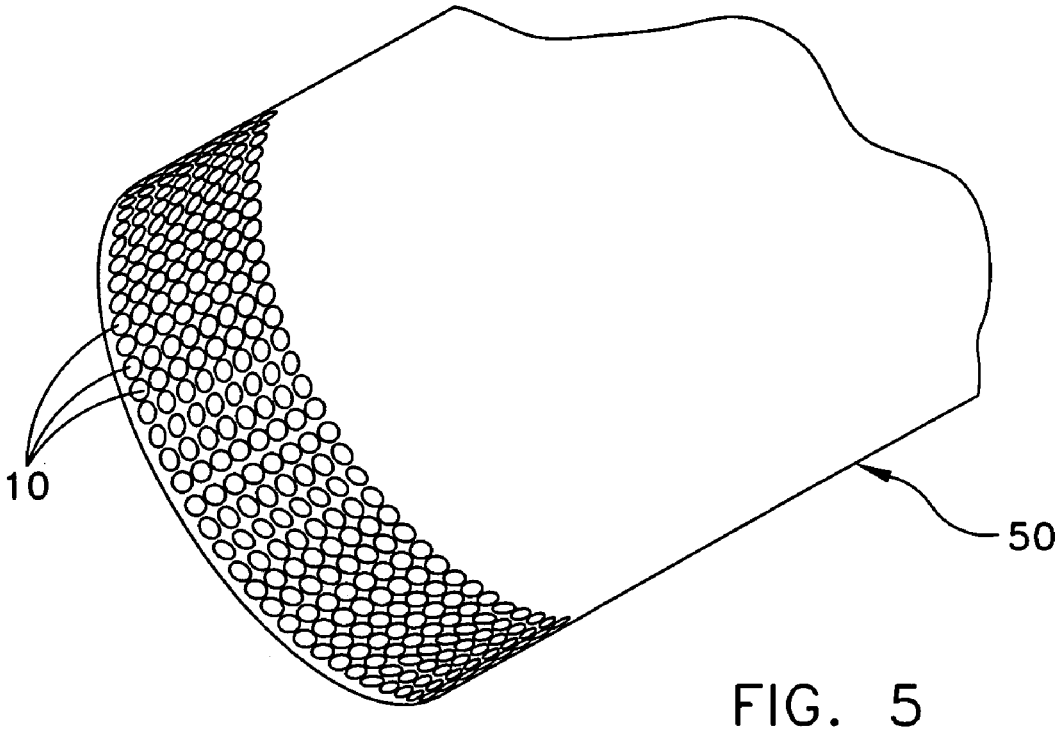
FIG. 5 is a perspective view of a multiplicity of arrays of the type shown in FIG. 1 mounted on a surface singly curved.
Figure 6:
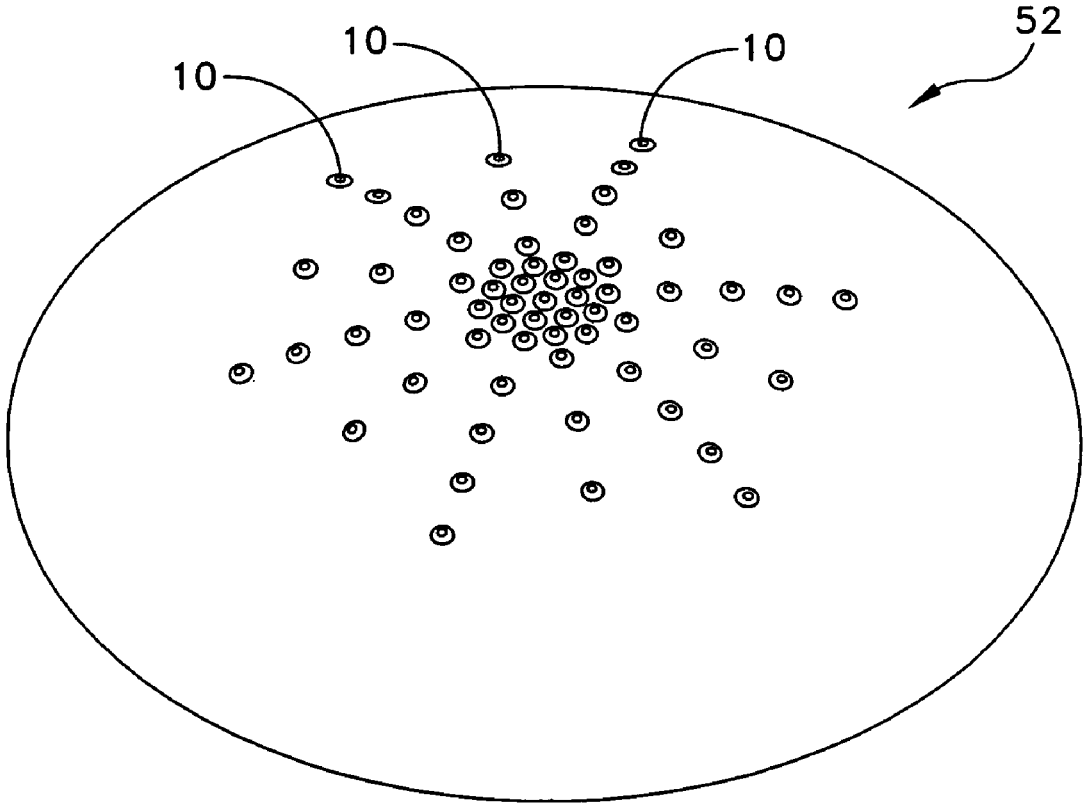
FIG. 6 is similar to FIG. 5, but showing arrays mounted on a complex curved surface.

In view of the flexibility of the array 10, it may be mounted on the hulls of underwater vehicles. As is illustrated in FIG. 5, the arrays 10 are sufficiently flexible to be wrapped around and mounted on a cylindrical body 50, such as that of a torpedo or other underwater vehicle or UUV. Further, as is illustrated in FIG. 6, the arrays 10 are flexible so as to be conformed to complex curves, and may be mounted on a nose cone 52, or similar structure, of an underwater vehicle. To further conform with the shape of the surface, the piezoelectric disks can be curved, the surface facing cymbal caps can have a different shape or both of these structures can be adapted.

There is thus provided a cymbal array which is adapted to be conformed to curved hull surfaces and mounted thereon, the array being adapted to convert electrical charges into acoustic signals for detecting underwater objects and/or underwater portions of surface objects.

It will be understood that many additional changes in the details, materials, and arrangement of parts, which have been herein described and illustrated in order to explain the nature of the invention, may be made by those skilled in the art within the principles and scope of the invention as expressed in the appended claims.

What is claimed is:

1. A flexible cymbal array for underwater vehicle applications, the array comprising:

a series of piezoelectric ceramic discs disposed in a line;

a first flex circuit comprising first annular members each affixed to a first side of and in electrical communication with one of said discs;

a first series of cymbal caps each mounted on one of said first annular members;

a second flex circuit comprising second annular members each affixed to a second side of and in electrical communication with one of said discs; and a second series of cymbal caps each mounted on one of said second annular members;

wherein said first and second flex circuits each comprise an electrically conductive layer disposed between two non-electrically conductive layers.

2. The array in accordance with claim 1 wherein said conductive layer comprises a flexible layer of copper.

3. The array in accordance with claim 1 wherein the non-electrically conductive layers comprise flexible layers of polyimide material.

4. The array in accordance with claim 1 wherein said first and second flex circuits are flexible.

5. The array in accordance with claim 4 wherein said discs are adapted to curve to conform to a curved surface upon which the disc is mounted.

6. The array in accordance with claim 4 wherein said discs are connected throughout peripheries thereof to peripheral portions of said cymbal caps and said cymbal caps are expandable and compressible at the center thereof by piezoelectric deformation of said discs.

7. The array in accordance with claim 6 wherein the peripheral portions of said cymbal caps comprise annular flanges which overlie the flex circuit annular members and the disc peripheral portions.

8. The array in accordance with claim 1 wherein:

said first flex circuit further comprises tabs that interconnect adjacent ones of said first annular members; and said second flex circuit further comprises tabs that interconnect adjacent ones of said second annular members.

9. The array in accordance with claim 8 wherein each of said flex circuits is provided with an electrical lead extending from one end annular member of each of said flex circuits, the lead comprising a linear continuation of one of said flex circuits.

10. The array in accordance with claim 9 wherein said discs are each in electrical communication with said conductive layers, said tabs, other of said discs, and one of said leads, and are insulated from electrical communication with said cymbal caps.

11. The array in accordance with claim 10 wherein said cymbal caps are of a material selected from a group of materials consisting of brass, tungsten, titanium, and alloys thereof.

12. The array in accordance with claim 9 wherein said cymbal caps are of a plastics material.

13. The array in accordance with claim 1 wherein each of the cymbal caps mounted on one of said first annular members is opposed to one of the cymbal caps mounted on one of said second annular members.

14. A cymbal array for underwater vehicle applications, the array comprising:

a series of piezoelectric ceramic discs disposed in a line, said discs being separated from each other;

a first flex circuit fixed to a first side of said discs, said first flex circuit comprising a plurality of first annular members each fixed to the first side of one of said discs, said first annular members each being of a diameter substantially equal to a diameter of the disc to which the first annular member is fixed, said first annular members each being connected by a first tab to an adjacent first annular member, said first flex circuit comprising a conductive layer laminated between two polyimide layers;

a first series of cymbal caps each mounted on one of said first annular members;

a second flex circuit fixed to a second side of said discs, said second flex circuit comprising a plurality of second annular members each fixed to a second side of one of said discs, said second annular members each being of a diameter substantially equal to a diameter of the disc to which the second annular member is fixed, the second annular members each being connected by a second tab to an adjacent second annular member, said second flex circuit comprising a conductive layer laminated between two polyimide layers; and a second series of cymbal caps each mounted on one of said second annular members and opposed to one of the caps of said first series of cymbal caps.

* * * * *